US010412483B2

(12) United States Patent
Bigeh

(10) Patent No.: US 10,412,483 B2
(45) Date of Patent: Sep. 10, 2019

(54) MULTI-ELEMENT SHIELDED MICROPHONE AND SUSPENSION SYSTEM

(71) Applicant: Audix Corporation, Wilsonville, OR (US)

(72) Inventor: Fred Bigeh, Wilsonville, OR (US)

(73) Assignee: Audix Corporation, Wilsonville, OR (US)

( * ) Notice: Subject to any disclaimer, the term of this patent is extended or adjusted under 35 U.S.C. 154(b) by 753 days.

(21) Appl. No.: 15/161,204

(22) Filed: May 21, 2016

(65) Prior Publication Data

US 2016/0353200 A1 Dec. 1, 2016

Related U.S. Application Data

(60) Provisional application No. 62/168,739, filed on May 30, 2015.

(51) Int. Cl.
*H04R 1/32* (2006.01)
*H04R 1/08* (2006.01)

(52) U.S. Cl.
CPC ..... *H04R 1/326* (2013.01); *H04R 1/083* (2013.01); *H04R 2201/021* (2013.01); *H04R 2420/09* (2013.01)

(58) Field of Classification Search
CPC ..... H04R 1/326; H04R 1/083
USPC ..... 174/88 C; 381/92
See application file for complete search history.

(56) References Cited

U.S. PATENT DOCUMENTS

2011/0122608 A1* 5/2011 Napier ..... F21V 21/104 362/184
2013/0264450 A1* 10/2013 Bigeh ..... F16M 11/14 248/288.31

* cited by examiner

*Primary Examiner* — Timothy J Thompson
*Assistant Examiner* — Charles Pizzuto
(74) *Attorney, Agent, or Firm* — Hancock Hughey LLP

(57) ABSTRACT

A multi-element below-ceiling and shielded microphone that is combined with a mounting system is described. The microphone is used with an adaptor apparatus and system that allows the height of the microphone over a table and the rotational position of the mics to be easily adjusted and fixed, and such that a plenum may be established at the interface of the ceiling and the suspension cable if desired.

16 Claims, 14 Drawing Sheets

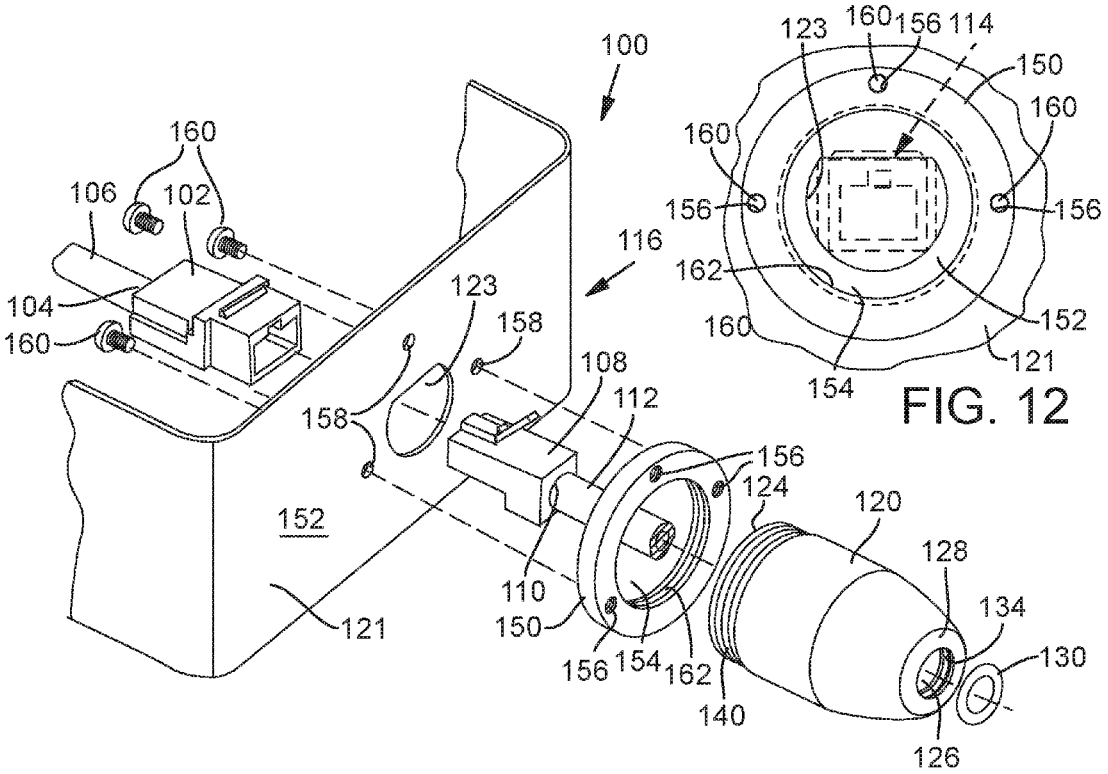
FIG. 12
FIG. 11
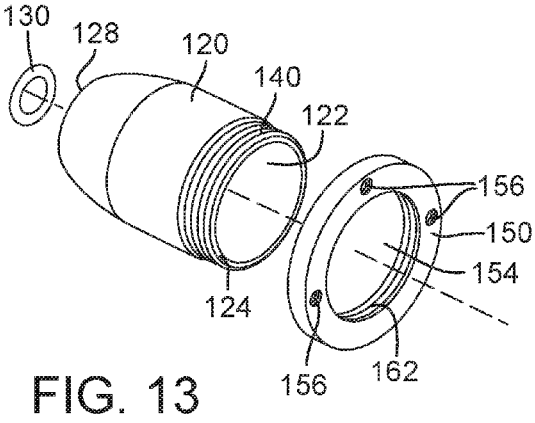
FIG. 13

MULTI-ELEMENT SHIELDED MICROPHONE AND SUSPENSION SYSTEM

TECHNICAL FIELD

The present invention relates to multi-element microphones, and more particularly, a three-element below-ceiling and shielded microphone that is combined with a mounting system that defines a plenum rated barrier that allows for variable and consistent placement of the microphones.

BACKGROUND

There are numerous microphones on the market that screw on a capsule to a field effect transistor ("FET") assembly and which send a signal to the microphone amplification stage. The mic signal is then sent to a mix board. But this type of signal is susceptible to radio frequency ("RF") noise such as is produced by a cellular phone, TV, microwave oven or other common devices, as well as other types of noise due to the wires from the FET assembly being exposed (i.e., not shielded) until they reach the amplification stage.

There are microphones available on the market today that are RF shielded; such as pencil microphones or podium microphones in which the capsule is connected directly to the microphone metal tube housing or gooseneck, then to electronics in the microphone or at the base of gooseneck mic. The housing all the way down to the electronics is metal and therefore there are no exposed wires and the microphone housing or grill shields against RF. However, there are no known available multi-element microphones that have the electronics and capsule shielded from RF. Part of the reason is that it can be difficult to attach and capture all of the microphones and the required electronics in one contiguous housing.

The microphone of the present invention is defined by a tri-element design that has the electronics and capsule RF shielded in one housing so that there are no exposed wires and so that the devices are shielded against RF noise getting into the audio signal.

Further, wired microphones require a cable that electrically connects the microphone to the electronics or the mixer that power and control the microphone. Often, the cabling that connects the mic to the electronics creates difficulties in both positioning the mic in desired locations, and in routing the cable. For instance, if the mic is suspended by the cable and the user wants it in a particular orientation other than vertical, the cable tends to spin, making precise directional control difficult. The cable routing is also a problem in many installations. Thus, in many localities building codes, fire codes and similar ordinances place specific requirements for creating a plenum between the living or working space and the space above a drop ceiling. When the microphone cable is extended through the drop ceiling, the cable that does not create a tight seal and may compromise the plenum rating of the installation by creating a passageway from the occupied space to the space above the drop ceiling. In order to maintain the plenum rating, the opening through the ceiling where the cable extends through the ceiling is often sealed to prevent passing of air through the opening and the cable, if exposed in the plenum space, must be plenum rated or which is LSOH ("low smoke zero halogen") material. Alternately, the cable may be run under the ceiling rather than passing it through the ceiling. This tends to be unsightly.

With existing wired microphones that have the cable extending through the ceiling with a sealed opening, the length of the cable cannot be readily adjusted below the ceiling. Therefore, changing the length of the cable to reposition the mic (both in terms of dimension and directional position) requires of the mic requires that the cable is cut, extra cable added to adjust the length, and the electronics reconnected. If the cable is shortened, the coiled up cable can get in the way and is unsightly.

There is a need therefore for apparatus that facilitates adjustment of wired microphones without destroying plenum ratings. The specific type of wiring or cabling will depend upon the types of equipment that are being wired. A very common type of cabling connection that is used in a variety of settings are the "registered jack"—"RJ"—types of connectors. These connectors are standardized physical network interfaces for connecting telecommunications or data equipment. There are many different standard designs for RJ connectors such as RJ11, RJ14, RJ21, RJ35, RJ45, Rj48 and numerous others. For purposes here, RJ connectors include a male plug attached to one end of a cable that leads to, for example, an electronic device of some kind, and a female plug attached to one end of the cable to which the electronic device is to be connected and which leads to, for example, a service provided by a local exchange carrier. The female connector typically terminates at a wall or ceiling plate that is supported by some kind of a junction box in the wall or ceiling and the cable extends from the female connector.

The standard RJ setup just described does not contemplate any seal between the male and female ends of the connectors and as such, cannot provide a plenum seal between the spaces separated by the wall or ceiling barrier. As such, where there is a desire or need to maintain a plenum seal across the barrier the RJ type of connectors present a plenum-seal-destroying problem. There is a need, therefore, for apparatus that allows a plenum seal where barrier-penetrating connectors such as RJ connectors are used.

BRIEF DESCRIPTION OF THE DRAWINGS

The invention will be better understood and its numerous objects and advantages will be apparent by reference to the following detailed description of the invention when taken in conjunction with the following drawings.

FIGS. 1 through 15 are drawings from US Patent Publication No. 2016/0126715, which is assigned to the assignee of the present provisional application and the entire disclosure of which is incorporated herein by this reference, and in which:

FIG. 1 is a perspective exploded view of a first embodiment of a cable microphone adaptor according to the present invention, illustrating the adaptor from an angle that shows one side of the components of the adaptor.

FIG. 2 is a perspective view of the adaptor shown FIG. 1 but showing the adaptor from an angle that shows the components of the adaptor from the opposite side of the components from the view of FIG. 1.

FIG. 3 is a side elevation and cross sectional view of the assembled adaptor according to the present invention to illustrate the internal structures. In FIG. 3 the cap has been tightened so that the microphone cable is immovably secured in the adaptor.

FIG. 4 is a side elevation and cross sectional view of the assembled adaptor similar to the view of FIG. 3, but in FIG. 4 the cap has been loosened so that the microphone cable is movable relative to the adaptor as illustrated with the arrows A and B.

FIG. 5 is a close up view of a second embodiment of an adaptor according to the present invention, showing the adaptor components in a partially assembled condition.

FIG. 6 is a perspective view of a third embodiment of an adaptor according to the present invention, showing the adaptor assembled and a microphone attached to the microphone cable.

FIG. 7 is a perspective view of the adaptor shown in FIG. 6, with the adaptor extending through a ceiling tile so that just the external portion of the adaptor and microphone cable are in the view FIG. 8 is a perspective view of the installation of FIG. 7, showing the microphone on the microphone cable FIG. 9 is a perspective view of the adaptor of FIG. 1 with the adaptor installed in a junction box.

FIG. 10 is a perspective view of the junction box seen in FIG. 7 with a second adaptor of the type shown in FIG. 6 extending through the underlying ceiling and into the junction box.

FIG. 11 is perspective and exploded view of a plenum seal apparatus according to an embodiment of the invention and for use with through-barrier cabling that uses connectors such as the registered jack type of connectors.

FIG. 12 is an elevation view taken from the interior of a junction box of the plenum seal apparatus illustrated in FIG. 11, with the cabling and female end of the plug not shown.

FIG. 13 is a perspective exploded view of the plenum cap according to the embodiment illustrated in FIG. 11.

FIG. 14 is a side sectional and partially exploded view of the embodiment shown in FIG. 11, illustrating the apparatus with the male and female couplers attached but with the components of the plenum seal apparatus not fully connected.

FIG. 15 is a side sectional view of the components shown in FIG. 14 in a fully assembled condition so as to create and maintain a plenum seal.

DETAILED DESCRIPTION OF ILLUSTRATED EMBODIMENTS

The invention will now be described in detail with reference to the drawings. It will be understood that relative directional terms are used at times to describe components of the invention and relative positions of the parts. As a naming convention, the plane of the floor in a living or work space is considered to be a generally horizontal surface. The ceiling is a plane that in most installations is parallel to the floor, though not always. Other relative directional terms correspond to this convention: "upper" refers to the direction above and away from the ground plane; "lower" is generally in the opposite direction, "inward" is the direction from the exterior toward the interior of the adaptor, "vertical" is the direction normal to the horizontal ground plane, and so on.

Figure 1:
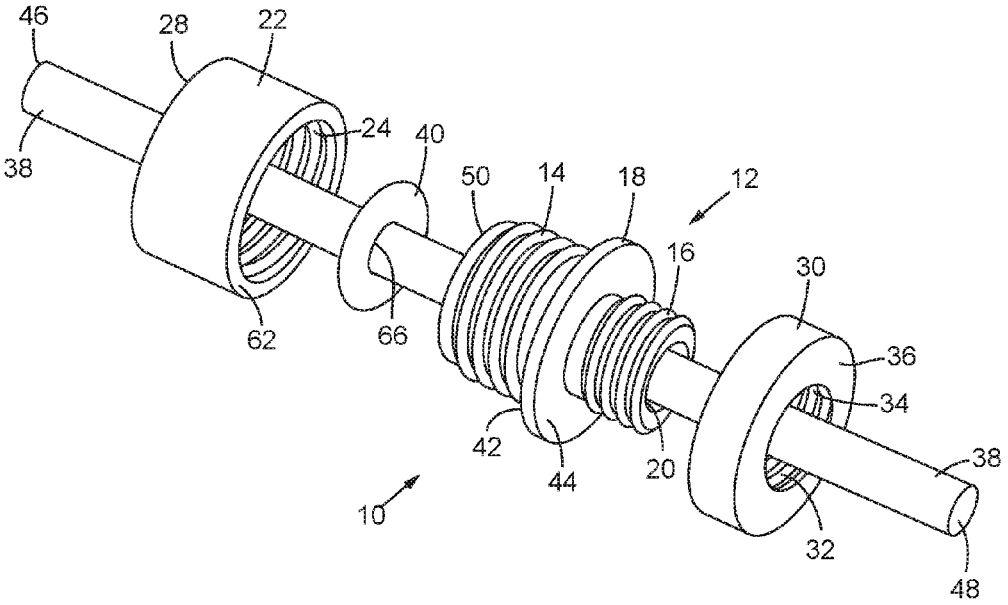
Figure 1A:
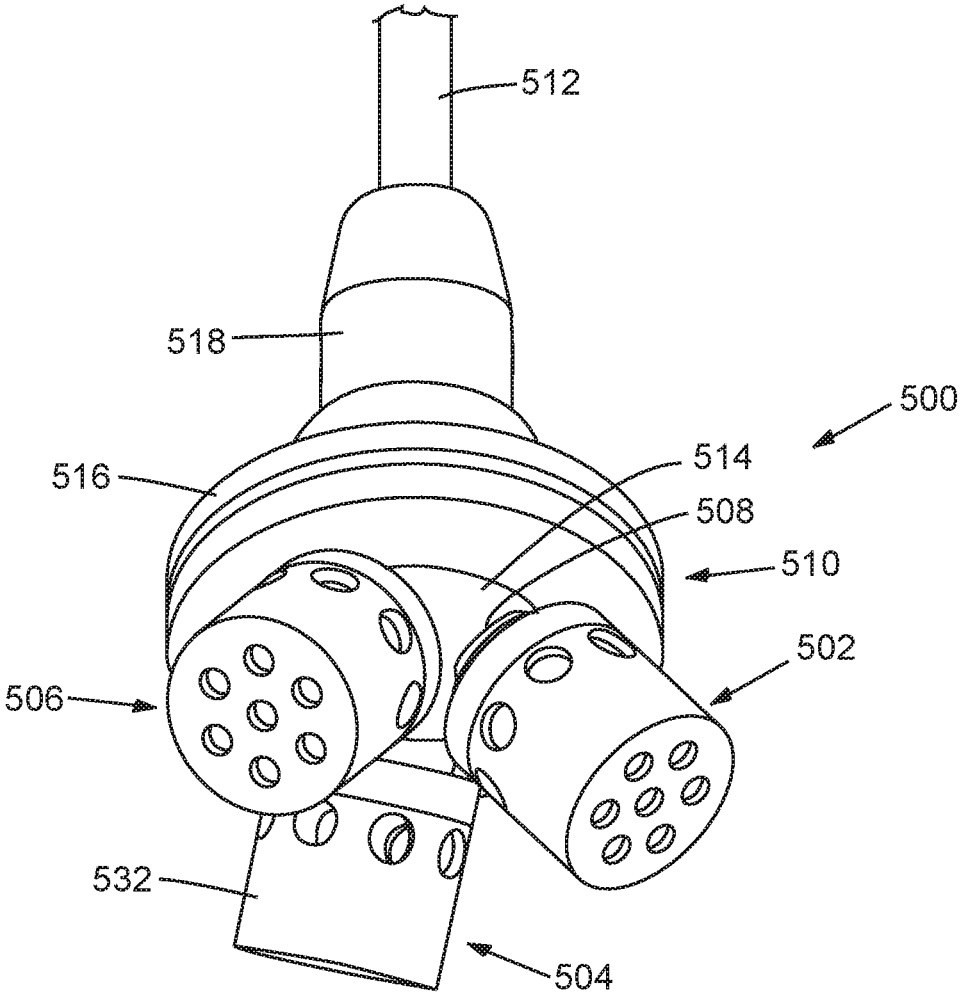
FIG. 1A is a perspective view of a three-element shielded microphone according to the present invention shown with a part of the suspension cable.

With reference to FIG. 1A, a multi-element shielded microphone assembly 500 is shown in a preferred embodiment in which the assembly includes three microphones (referred to at times in the shorthand form "mics" or "mic"), labelled 502, 504 and 506, respectively. Each mic is attached to a housing 510. More specifically, each of the three mics is attached at is base end 508 to a housing 510 with an integral attachment. As shown in the drawing of FIG. 1C, the mics may include a threaded base end 508 that is threaded into a threaded opening in the housing 510. The three mics 502, 504 and 506 are spaced around the housing 510 at equal intervals, and therefore at about 120 degree spacing relative to the adjacent mics. Each of the threaded openings in housing 510 are thus at the same 120 spacing relative to adjacent openings. With continuing reference to FIG. 1C, if we assign the vertical axis defined by the suspension cable 512 to be a fixed vertical line, then the mics are angled outwardly from the vertical by an angle β, which is preferably about 30 degrees as shown with the axis shown on FIG. 1C.

Housing 510 is defined by a rounded and downwardly oriented hemispherical bulb 514 into which the threaded openings are formed. The rounded bulb 514 is attached at its base to a base flange 516 and the base flange includes fittings 518 for attaching the suspension cable 512.

Figure 1B:
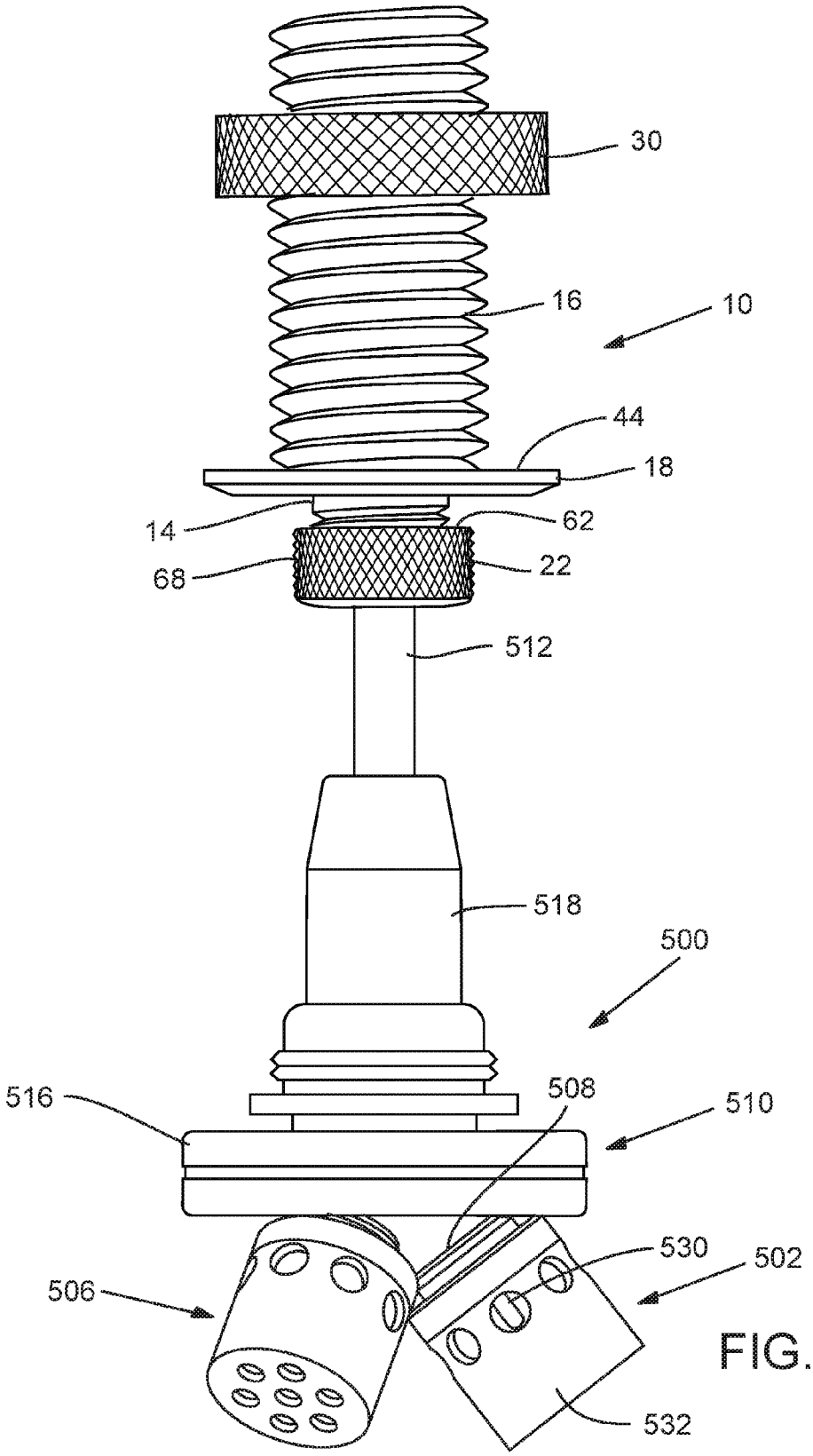
FIG. 1B is a side elevation view of the three-element shielded mic shown in FIG. 1A and also illustrating a ceiling interface for the suspension cable.
Figure 1C:
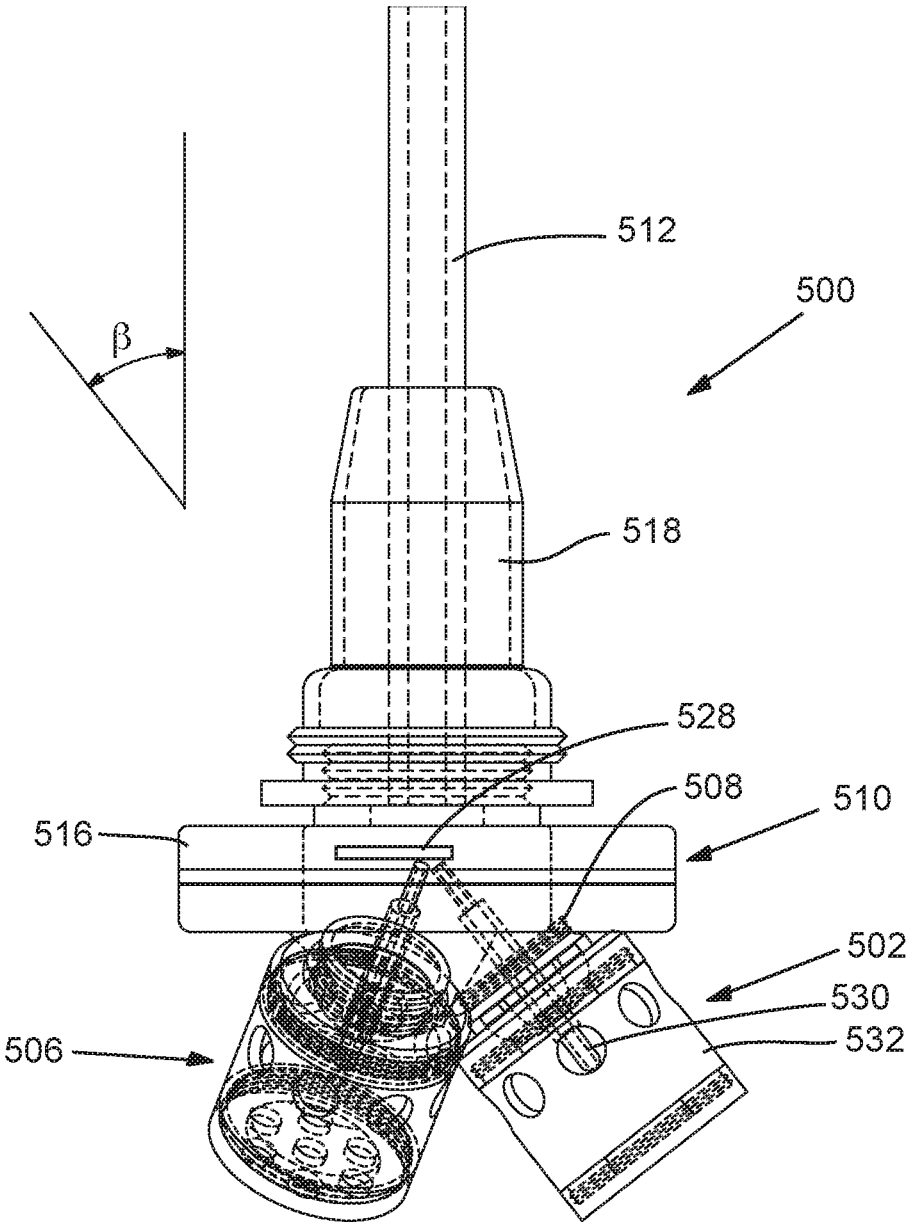
FIG. 1C is a side elevation view of the mic shown in FIG. 1B with the ceiling interface omitted.
Figure 1D:
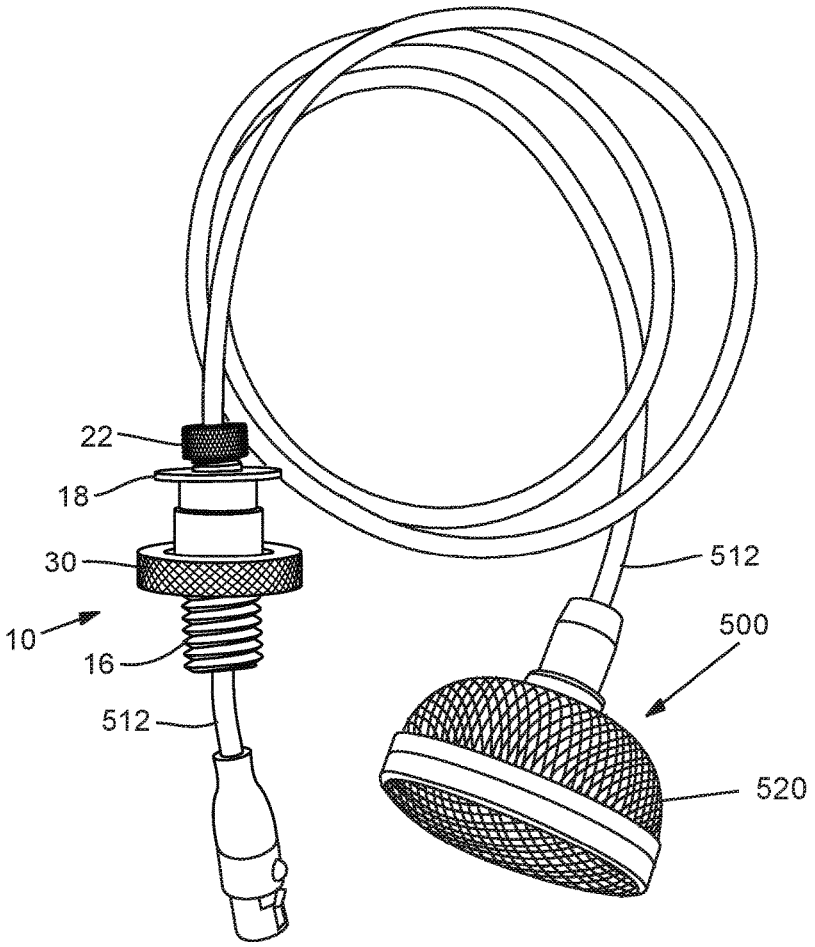
FIG. 1D. is a side elevation view of the three-element shielded mic shown in FIG. 1A, including the grills covering the mic, the suspension cable and the microphone adaptor mechanism that may be used with the mic.

With reference to FIG. 1D, in the finished microphone assembly 500 a grill 520 is attached to the assembly.

As best shown in FIGS. 1B and 1D, the microphone assembly 500 is used with an adaptor apparatus and system as detailed below and as shown in the drawings that allows the height of the microphone over a table and the rotational position of the mics 502, 504, 506 to be easily adjusted and fixed, and such that a plenum system is established at the interface of the ceiling and the suspension cable 512. As shown in the schematic illustration of FIG. 16, the microphone assembly 500 may be suspended by its suspension cable 512 below the ceiling and over a conference table 600 in a conference room. In such an installation, each of the three microphones 502, 504 and 506 contained in assembly 500 has an area of coverage that is essentially in the shape of a cone, much like the light that is emitted from a flashlight, and as illustrated with the cones identified with reference numbers 550, 552, 554 in FIG. 16. By adjusting the vertical position of the microphone assembly 500 over the table, the area of coverage of each of the individual microphones may be easily adjusted to accommodate three or more individuals seated at the table, or other audio sources. That is, when the assembly is adjusted vertically upward so that the distance of the mics above the table is greater, the area of coverage of each mic is increased. Moreover, by coupling the microphone assembly 500 with the adaptor mechanisms described below the axial position of the three microphones may be easily adjusted and fixed by rotation of the suspension cable 512 in the adaptor mechanism—once the position is set and the adaptor is tightened there is no axial twisting of the suspension cable and the mics are fixed in the desired pointing direction.

With returning reference to FIGS. 1B and 1C, each of the individual mics 502, 504 and 506 includes a spring-loaded pogo pin 530 that makes direct contact between the electronics and mic capsule. The pogo pins 530 are conventional spring-loaded pins that are soldered to a printed circuit board 528 located in the base flange 516 of housing 510. When the capsule 532 is screwed onto the microphone base 534 the interior of the capsule compresses the pogo pin and thus causes the pin to make an electrical connection with the PCB 528 in the housing 510. When the capsule is screwed into the opening in the housing, the entire assembly 500 is shielded. By bringing pogo pins and mics so closely together, the phase anomaly due to sound arriving at different mics at different times is minimized so that the three mics have very good "phase coherence". The "shielding" provided by the assembly is to shield electronic radiation, noise caused by electronic radiation. The shielding is internally shielded—with or without grill 520, the shielding is the same.

Figure 17:
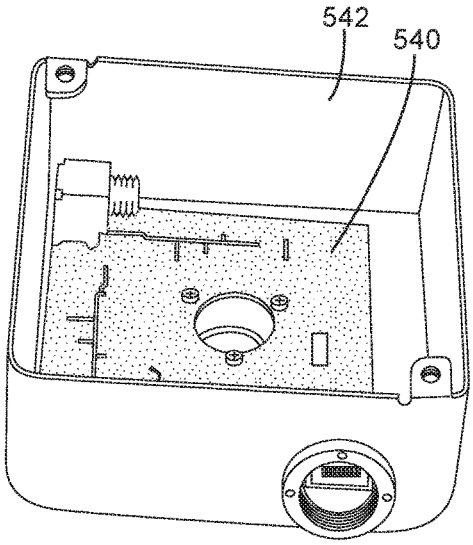
FIG. 17 is a perspective view of an above-ceiling junction box that may be used in accordance with the present invention.

The invention utilizes two circuit boards: impedance conversion shielding board 528 in the microphone assembly 500, then a second board 540 in the above-ceiling junction box 542 in FIG. 17.

As described in detail below, mic assembly 500 is combined with an adaptor 10 that allows for precise positioning of the mic in a room and which can establish a plenum seal between the room and the space above the room's ceiling, depending upon the materials used in the installation. The adaptor 10 is described now with reference to FIGS. 1 through 15.

Figure 2:
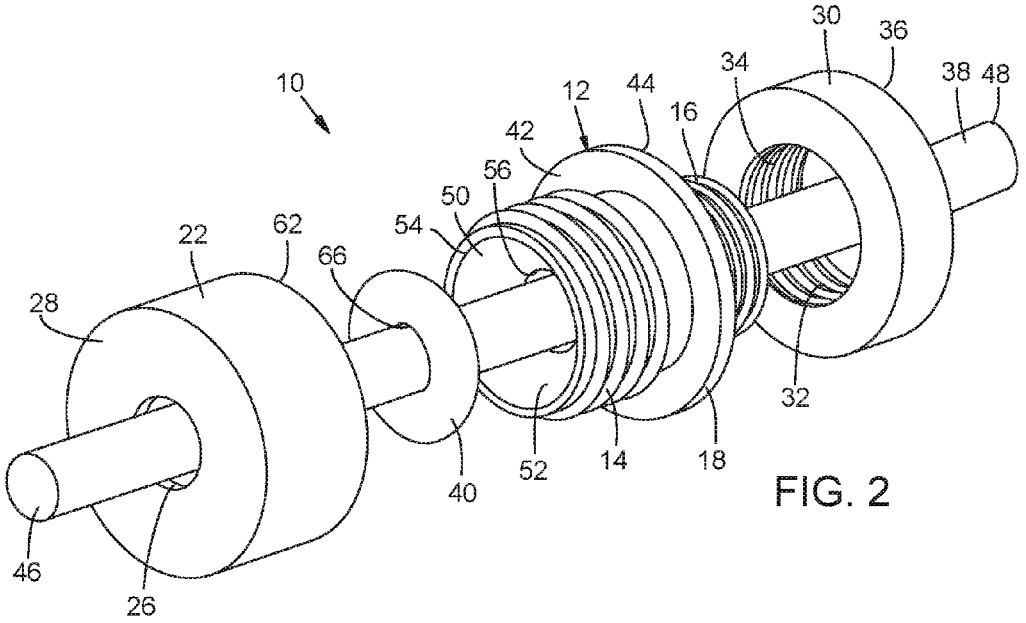

Turning now to FIG. 1, a first embodiment of an adaptor 10 is shown in FIGS. 1 and 2. The adaptor 10 comprises a main body 12 having a first threaded end 14 and an opposite second threaded end 16 with a circumferential flange 18 separating the first and second threaded ends and extending from the main body 12. A bore 20 extends longitudinally through main body 12. A cap 22 has an internally threaded interior 24 and a bore 26 through the outer end 28 of the cap. Cap 22 threads onto first threaded end 14. A nut 30 has an internally threaded interior 32 and a bore 34 through the outer end 36 of the nut. Nut 30 threads onto second threaded end 16.

A microphone cable 38 extends through bore 26 in cap 22, bore 20 through main body 12 and bore 34 in nut 36. An O-ring 40 is captured between cap 22 and main body 12 as detailed below and the cable 38 extends through the central opening 66 in O-ring 40. The O-ring is a pliable material such as rubber and the diameter of central opening 66 of the O-ring is just slightly larger than the outer diameter of mic cable 38 so that the mic cable is easily inserted through the central opening of the O-ring.

In the assembled adaptor, with cable 38 extending through the bores through the components just described, cap 22 threads onto main body 12 with the threaded interior 24 of the cap threaded onto first threaded end 14, and with O-ring 40 between the cap and the main body. On the opposite end of the main body 12, the threaded interior 32 of nut 30 is threaded onto second threaded end 16 of main body 12.

Circumferential flange 18 has opposite flattened sides which are referred to herein as "adjustment side" 42 and the opposite, "fixing side" 44. As detailed below, adaptor 10 is designed to extend through a bore in a surface such as a ceiling, a wall, or a wall of a junction box to give a few examples. The size of the bore through the wall is greater than the size of the seconded threaded end 16 but less than the diameter of flange 18. When adaptor 10 is assembled, the second threaded end 16 is inserted through such a bore until the fixing side 44 of the flange 18 abuts the outer surface of the wall. For example, if the adaptor is installed through a bore in a ceiling tile, the second threaded end 16 is pushed through the bore in the tile until the fixing side of the flange 18 butts against the ceiling tile with the fixing side 44 of flange 18 pressed against the room-facing side of the tile. On the opposite side of the tile—that is, the side of the tile above the living space, in the plenum space, the nut 30 is threaded onto the second threaded end 16 to fix the main body 12 to the tile. The adjustment side 42 of the flange 18 thus faces toward the living-space below the ceiling tile. Typically, a microphone is attached to the end 46 of the microphone cable 38 while the opposite end 48 is attached to other electronics.

FIG. 2 is an exploded view similar to FIG. 1 except showing the components described above from the opposite angle. In this view it may be seen that main body 12 has an opening 50 interiorly of first threaded end 14 and that the wall 52 of the opening 50 angles or slopes inwardly toward the center of the main body. In other words, the diameter of opening 50 at the outermost edge 54 of the main body 12 is greater than the diameter of the opening moving in the direction toward the center of the main body—to the right in the view of FIG. 2 to define a frusto-conically shaped surface. The diameter of opening 50 at the outermost edge 54 of the main body 12 is roughly the same as the outer diameter of O-ring 40. Moving toward the center of the main body, the diameter of opening 50 near the center 56 is less than the diameter of O-ring 40.

Figure 3:
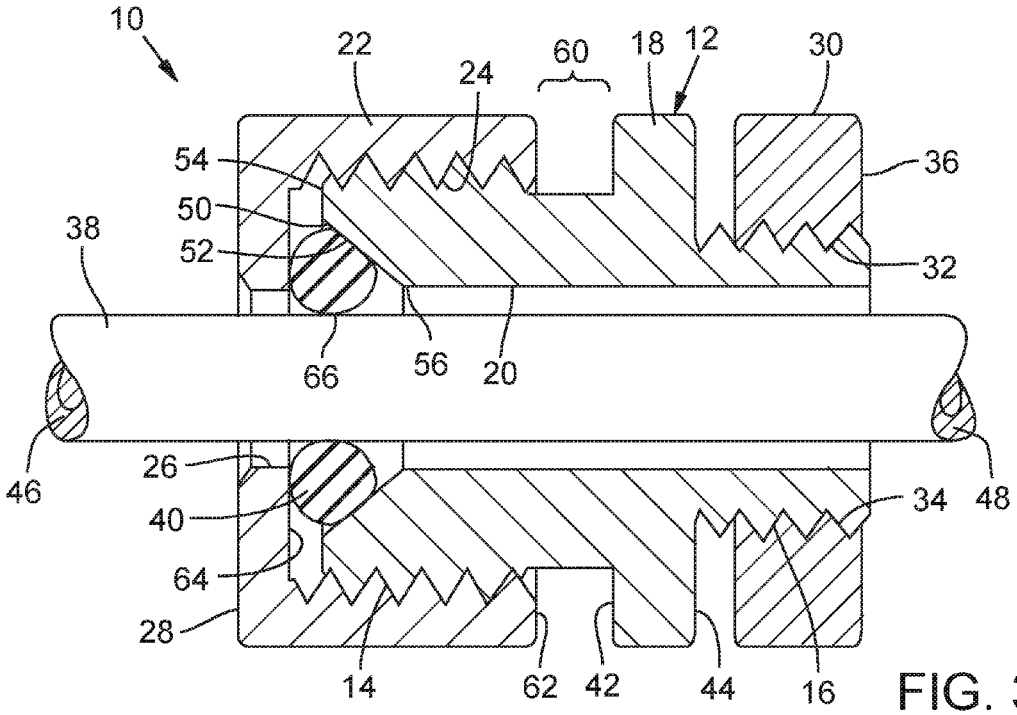
Figure 4:
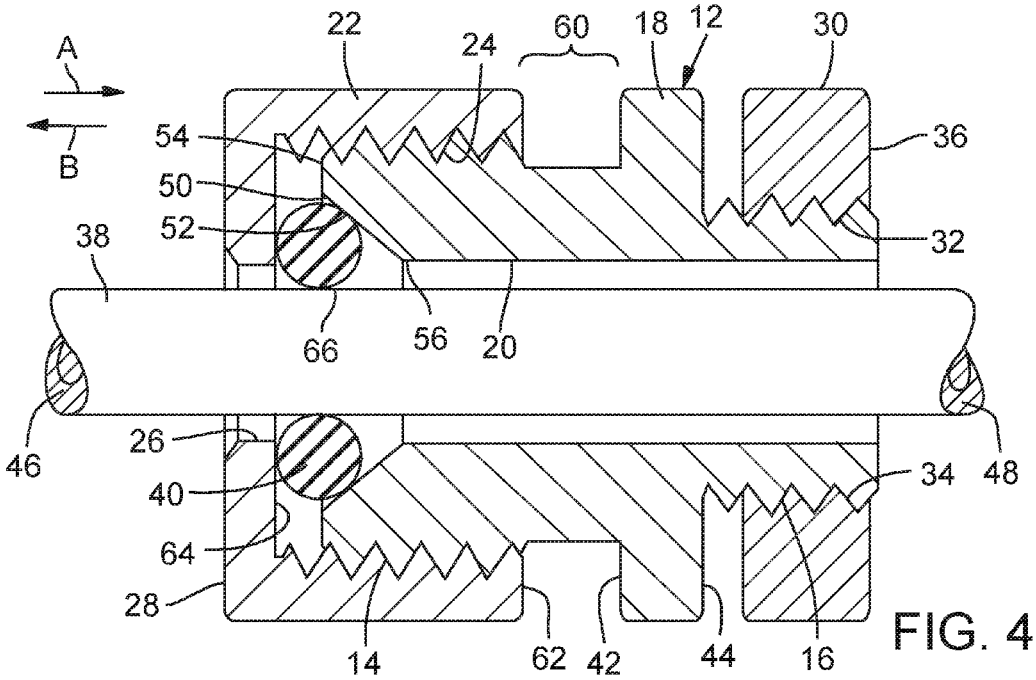

In FIGS. 3 and 4 the components described above and shown in FIGS. 1 and 2 are shown assembled. Thus, the cable 38 is extended through the components and the cap 22 is threaded onto first threaded end 14 of main body 12, and nut 30 is threaded onto second threaded end 16 of the main body. In FIG. 3 there is a space 60 between adjustment side 42 of flange 18 and the nearest, facing edge 62 of cap 22. This space allows for adjustment of the cap 22 on the threaded end 14—tightening and loosening the cap relative to the main body.

In FIG. 3, nut 22 is threaded tightly onto first threaded end 14 of main body 12. As the nut is threaded inwardly onto main body 12, O-ring 40 is forced inwardly in opening 50 so that the outer surface of the O-ring is forced along the narrowing sloped wall 52—the O-ring is pushed to the right in the view of FIG. 3 by the interior wall 64 of nut 22 that surrounds opening 26. As the O-ring 40 is forced into the gradually narrowing opening 50 and down the sloped wall 52, the O-ring 40 is compressed axially inwardly toward the center of opening 66 of the O-ring. As the O-ring thus compresses, the interior opening 66 of the O-ring is compressed tightly around cable 38. As this happens the O-ring compresses against the cable, capturing the cable 38 and making movement of cable 38 through adaptor 10 very difficult and thereby fixing the cable relative to the main body. Stated another way, when cap 22 is tightened onto main body 12, the cable is captured by the compression of the O-ring 40, which is compressed between interior wall 64, the sloping walls of opening 50, and the cable 38, so that relative movement between the cable 38 and the adaptor 10 is prevented (although the compressive capture of the cable by the O-ring may be overcome by pulling very forcibly on the cable 38, the amount of force required depending of course on the tightness of the cap on main body 12). As detailed below, when the cap 22 is tightened onto main body 12, there is an airtight seal formed through bore 20.

FIG. 4 illustrates loosening of cap 22 from its locked position shown in FIG. 3. In FIG. 4, cap 22 has been loosed from main body 12. As cap 22 is loosened on first threaded end 14, this causes decompression of O-ring 40 as the nut moves away from the flange 18 and concomitant lessening of the compression between O-ring 40 and cable 38. The space 60 in FIG. 4 is greater than the analogous space 60 in FIG. 3. This loosening of cap 22 releases the engagement between O-ring 40 and cable 38 and thus allows the cable 38 to be moved relative to the adaptor 10 in both directions as shown by arrows A and B.

This allows for simple repositioning of the microphone (which is attached to end 46 of the cable). Moreover, with cap 22 loosened from its locked or tightened position of FIG. 3, the cable 38 may be axially rotated relative to the main body 12. Rotation may be 360 degrees or more in either direction relative to the main body. This allows for increased ability to point the microphone in the desired direction. For example, if the microphone (or several microphones) are suspended from the ceiling over a conference table, the height of the mics relative to the table (i.e., arrows A and B) can be easily adjusted, and rotation of the cables and mics relative to the adaptor 10 allows the user to "point" the mics toward the desired sound source (e.g., people speaking) or away from unwanted sound sources (e.g., TV speakers, HVAC vents, etc.).

Figure 5:
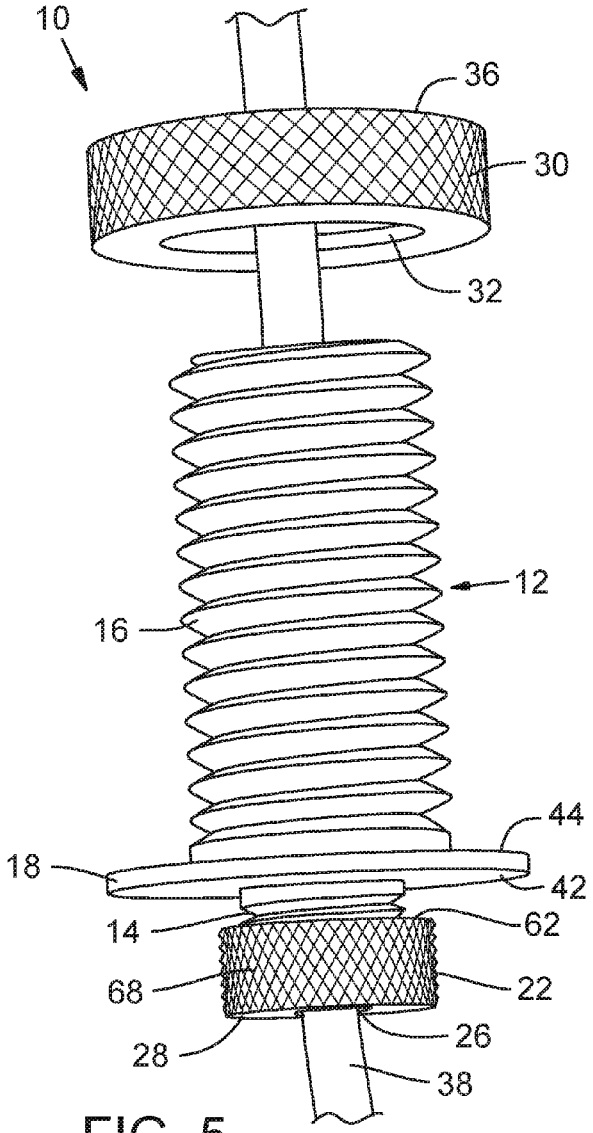

In FIG. 5 a second embodiment of an adaptor 10 according to the present invention is illustrated. Here, the second threaded end 16 of main body 12 is relatively larger and relatively longer than the first threaded end 14 and the nut 30 is shown spaced apart from the main body—that is, not threaded onto threaded end 16. This embodiment includes a cap 22 with a knurled surface 68. This embodiment would be used where the bore through which the main body is inserted in an installation is of larger size than the embodiment of FIGS. 1 through 4. It will also be appreciated that the second threaded end 16 may have one flattened side so that in cross section the threaded barrel is D-shaped rather than round. In this instance the second threaded end may be inserted through a bore that has a like D-shape in a wall or other surface. The mating D-shaped parts prevent rotation of the main body 12 relative to the surface.

Figure 6:
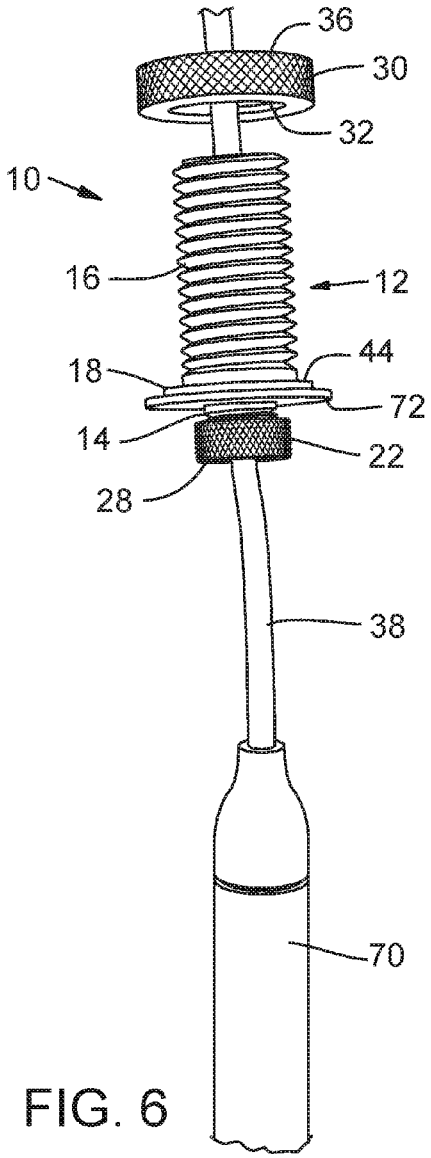

An adaptor 10 is shown with a microphone 70 on cable 30 in FIG. 6. In this embodiment, a finishing flange 72 is used between cap 22 and flange 18 to provide a finished appearance.

Figure 7:
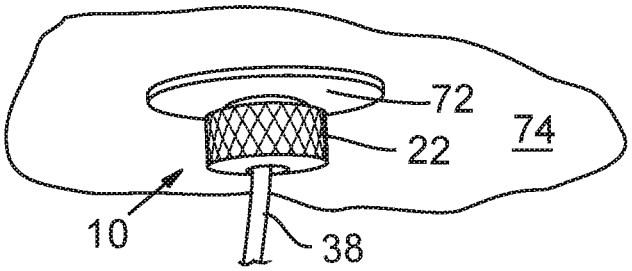
Figure 8:
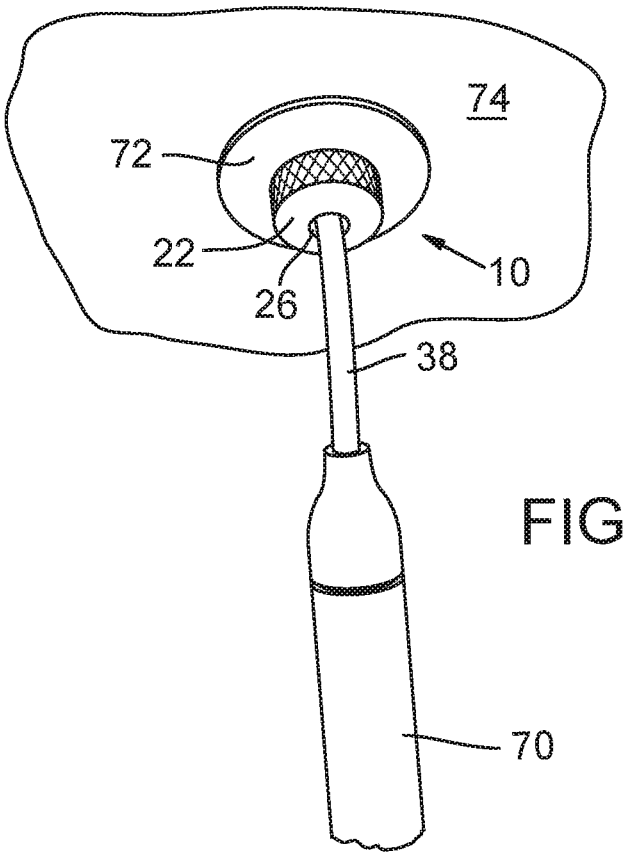

The embodiment of FIG. 6 is shown installed in a ceiling tile 74 in FIGS. 7 and 8. The finishing flange 72 provides a clean and finished appearance for the adaptor 10 on the interior-facing side of the ceiling tile 74.

Figure 9:
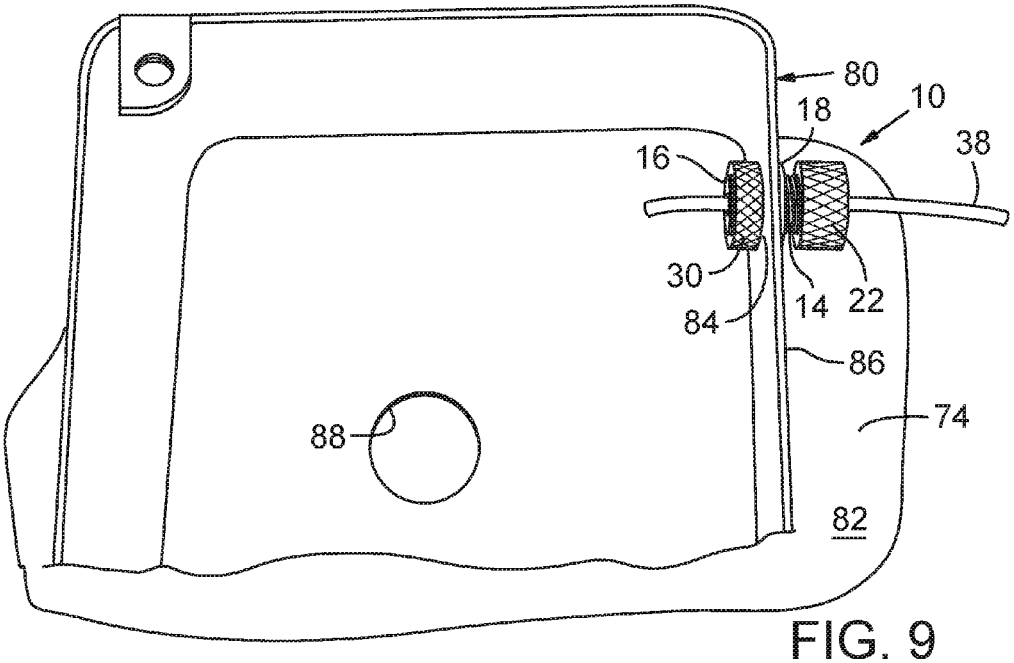

Turning now to FIG. 9, an adaptor 10 is shown as used with a junction box 80 that is shown attached to a surface 82, which in this instance is the upper surface of a ceiling tile such as ceiling tile 74 of FIG. 5. The "upper surface" 82 of the ceiling tile 74 is the surface of the tile that is above the room over which the tile is installed. In other words, the upper surface is the surface opposite the interior-facing surface shown in FIGS. 7 and 8. As may be seen the second threaded end 16 of main body 12 extends through a bore 84 in a wall 86 of junction box 80, which as noted above may be D-shaped when the second threaded end 16 is also D-shaped. The main body 12 is securely attached to wall 86 with nut 30, which when tightened captures the wall 86 around the bore 84 between the fixing surface 44 of flange 18 and the nut 30 (i.e., the portion of wall 86 immediately surrounding the bore 84 is captured between the nut and the flange—when the nut is tightened it secures adaptor 10 securely to the junction box). There is a bore 88 in the wall of the junction box 80 that rests against the surface 82 of ceiling tile 74.

Figure 10:
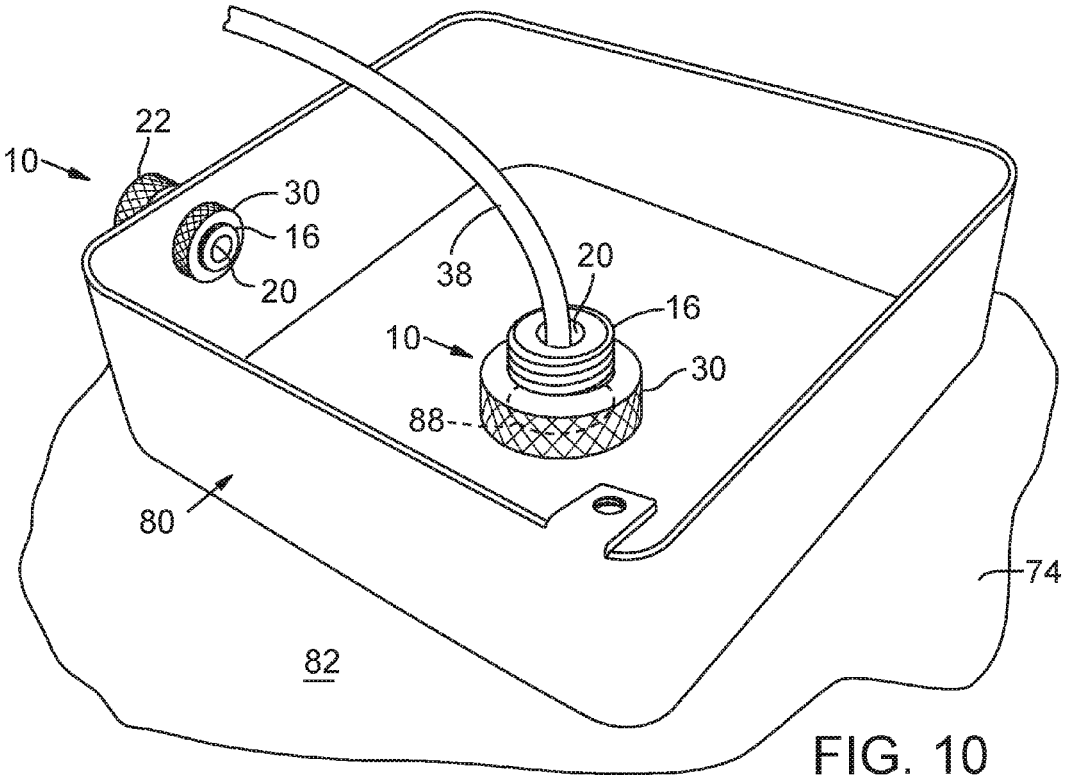

In FIG. 10 a second adaptor 10 has been assembled with junction box 80—the adaptor 10 through side wall 86 is shown in place as described above with respect to FIG. 9, but in this case, a bore has been formed in ceiling tile 74 so that the bore through the tile aligns with the bore 88 in the junction box. Adaptor 10 that extends through bore 88 is of the type of embodiment shown in FIG. 5, with a relatively larger and longer second threaded end 16. It will be appreciated that the adaptor extends through tile 74 as shown and described elsewhere With respect to FIG. 10 a significant length of cable 38 may be coiled in junction box 80. If a user wants to increase the length of the cable below the ceiling tile, for example, to reposition the microphone that is attached to the distal end of the cable, the cap 22 on adjustment side of the adaptor—which is the side of the installation shown in FIGS. 7 and 8 and which extends through the tile is loosened and this allows the cable to be pulled downwardly—the excess cable coiled in the junction box allows the length of the cable below the tile to be increased. The cable also extends through the adaptor 10 that is positioned in wall 86, which allows a second adjustment in the length of the cable 38.

The length of the cable 38 below the ceiling tile may also be shortened by reversing the sequence described above and pushing the cable back up through the adaptor, where it bunches up in the junction box 80.

When cap 22 is tightened to fix the cable 38 relative to the main body 12, there is no air-passageway through the main body because the O-ring 40 is compressed around the cable 38 as detailed above and thereby defines an air tight seal of the bore 20. There is, therefore, a plenum seal maintained between the space under the ceiling tile and the air space above the tile. Accordingly, the adaptor 10 of the present invention is usable in situations where the cable is routed through the ceiling (or wall) where a plenum seal rating is desired.

With reference now to FIGS. 11 through 15, a plenum seal apparatus 100 is detailed with respect to use with a registered jack type of cable connector. As noted above, a very common type of cabling connection that is used in a variety of settings are the "registered jack"—"RJ"—types of connectors. These connectors are standardized physical network interfaces for connecting telecommunications or data equipment such as a standard computer to a communications network interface such as a service provided by a local exchange carrier. As shown in FIG. 11, a female plug 102 is attached to an end 104 of cable 106 that extends to standard interconnections with, for instance, telecommunications connections. The male plug 108 is electrically attached to an end 110 of cable 112 that extends to, for instance, a computer (not shown) or other electronics equipment. The wiring used in cables 106 and 112, and their connections to pinouts in the female and male plugs 102 and 108 are conventional and need not be described here. The male and female plugs 102 and 108 are shown in their interconnected position in FIG. 15 and for purposes herein, the interconnected plugs are referred to as connected plug 114. A junction box 116 has a D-shaped opening 123 through which the connected plug extends to provide the electronic connection between one side of the junction box and the other. More specifically, a wall 121 of the junction box defines a barrier between adjacent spaces across which a plenum seal is to be created. It will be appreciated that the junction box 116 may be used at a wall or ceiling and the like, and that wall board or ceiling tiles may also be used. Regardless, the plenum seal apparatus 10 according to the invention is used where a plenum seal is desired between, for example, a living space on one side of the barrier defined by wall 121—the space on the right in FIG. 11, and the space on the opposite side of the wall 121—the space on the left in FIG. 11.

It will be understood there are many different standard designs for RJ connectors such as RJ11, RJ14, RJ21, RJ35, RJ45, Rj48 and numerous others. The connected plug 114 shown herein is a RJ45 connector but the RJ45 connector is used only to illustrate; it does not limit the invention.

Figure 14:
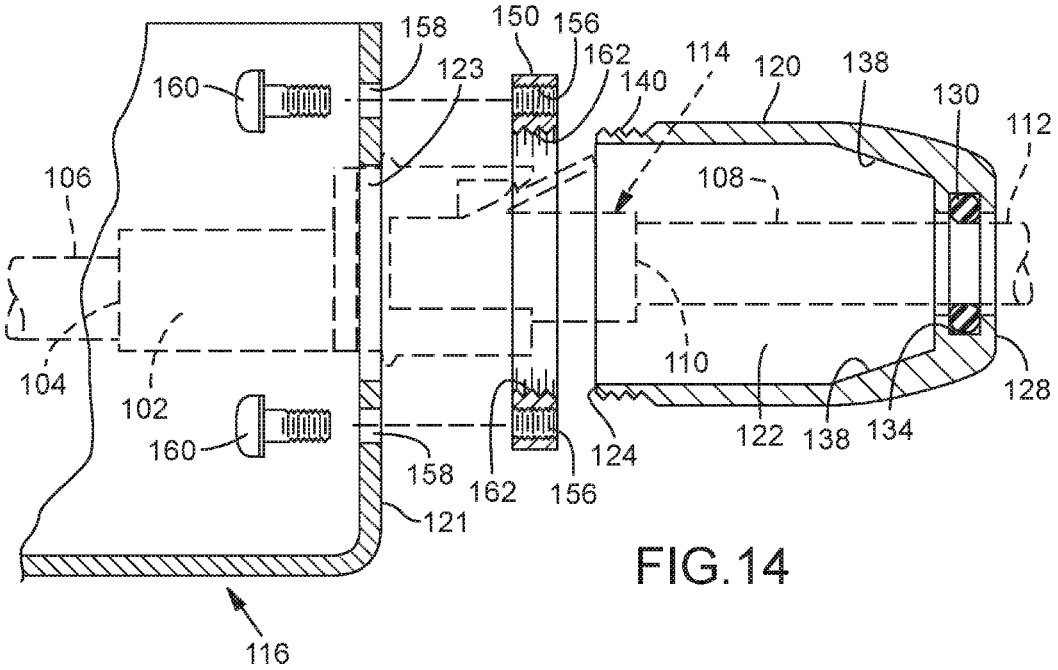
Figure 15:
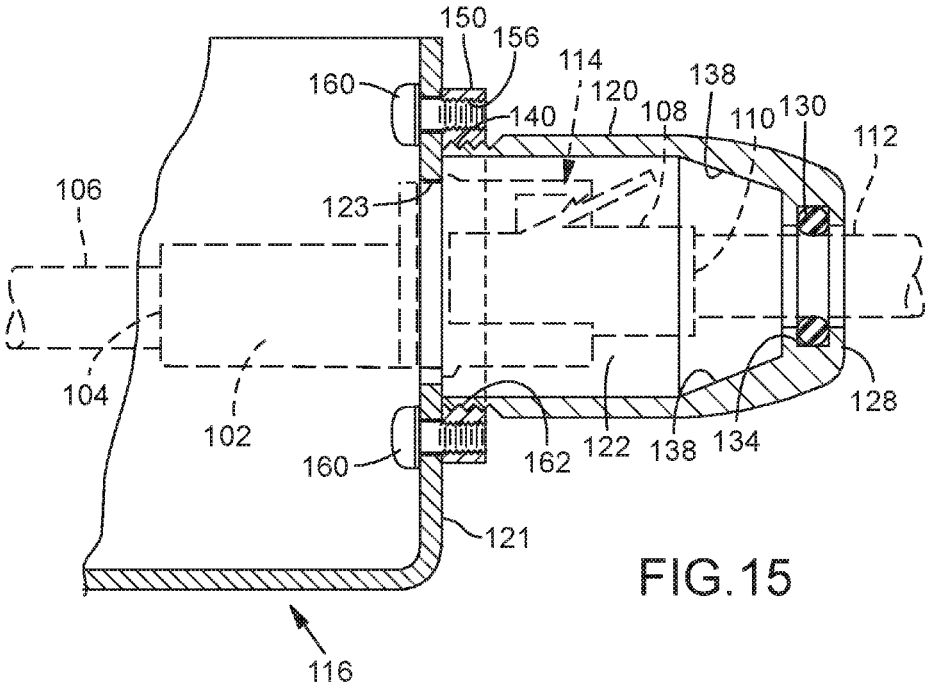

Plenum seal apparatus 100 is defined by a plenum cap 120 and a junction box adaptor 150 that is secured to junction box 116 and which serves as a base to which plenum cap 120 is attached when the unit is assembled. Each component is described separately beginning with plenum cap 120. Plenum cap 120 is an elongate, roughly bullet-shaped body having a hollow interior 122 and an open base end 124 and an opening 126 at the tip end 128 of the cap 120. The cable 112 extends through the hollow interior 122 and the opening 126 has a diameter that is slightly greater than the diameter of cable 112 so that the cable may be extended through the opening. A resilient O-ring 130 is received in a circumferential seat 134 formed in an interior shoulder 136 of cap 120 adjacent opening 126 (FIGS. 14 and 15). The diameter of O-ring 130 is less than the diameter of cable 112 so that when the O-ring is seated in circumferential seat 134 with cable 112 extending through the O-ring, the O-ring is compressed around the cable and such that air cannot flow past the O-ring. The plenum cap thus defines an air passage block to prevent air from flowing through the hollow interior 122. The compression seal established between O-ring 130 and cable 112 allows the plenum cap 120 to be slid along the cable without compromising the air-tight seal between cap and cable.

The diameter of the hollow interior 122 of plenum cap 120 increases in the direction from shoulder 136 to the base end 124 and there is thus a passageway defined through the plenum cap. As best seen in FIGS. 14 and 15, a sloped interior wall portion 138 increases the diameter of the hollow interior 122 so that the connected plug 114 is housed within a cavity defined in the hollow interior 122. The base end 124 of plenum cap 120 has external threads 140.

Junction box adapter 150 is a ring that is attached to the outer surface 152 of wall 121 of junction box 116 such that the open center 154 of adapter 150 is positioned over D-shaped opening 123. Three threaded bores 156 are spaced around the periphery of adapter 150 and bores 158 are drilled through junction box 116 around D-shaped opening 123 at equal spacing with bores 156. Three screws 160 are inserted through the bores 158 and are threaded into threaded bores 156 to secure the junction box adapter 150 to the wall 121 of the junction box with an air-tight seal. Other equivalent fasteners may be substituted for the screws 160 and sealants or a gasket may be used to enhance the air tight fit. As best seen in FIG. 12, when junction box adapter 150 is attached to junction box 116, the open center 154 of the adapter 150 leaves the D-shaped opening 123 unobstructed. The interior diameter of adapter 150 is threaded at threads 162 so that the external threads 140 at base end 124 of plenum cap 120 may be threaded onto threads 162 of adapter 150 to secure the cap to the adapter.

Assembly of plenum cap 120 with cable 112 will be evident from review of the drawings. Specifically, prior to the electrical attachment of male plug 108 to the wiring in cable 112 the end 110 of the cable is inserted through opening 126 of plenum cap 120. As noted, the diameter of O-ring 130 is slightly less than the diameter of cable 112 so as to facilitate an air-tight seal between the cable and the O-ring. As such, some force is required to push the cable through the O-ring. With the end 110 of cable 112 pushed through the O-ring the electrical connections between wiring in the cable and the corresponding pins in the male plug 108 may be made.

Junction box adapter 150 is attached to junction box 116 with screws 160 and cable 106, with female plug 102 attached to end 104, is positioned in junction box 116 near D-shaped opening 123. The male plug 108 is connected to female plug 102 as usual and plenum cap is threated onto junction box adapter 150 as best shown in FIG. 15. As the plenum cap 120 is rotated to thread it into adapter 150 the O-ring 130 slips over the outer surface of the cable, allowing relative rotation between the plenum cap and the cable. The cable is prevented from rotation by virtue of physical interference between the flattened portion of D-shaped opening 123 and the square body shape of the connected plug 114. The size of the cavity defined in hollow interior 122 of plenum cap 120 relative to the size of the connected plug may vary and the invention contemplates that some plugs 114 may be small enough that there is relative movement between the plug, the cap, and the barrier defined in this case by the wall 121. Moreover, the D-shaped opening 123 may be circular as described above with reference to, for example, bore 80. However, a plenum seal is defined once the cap 120 is secured to the adapter 150 with the O-ring in sealing contact with the cable, and as such any movement of the plug relative to the fixed structures is not of consequence and will not destroy the plenum seal. More specifically, the air tight, fluid seal between the O-ring and the cable is not hindered by either axial rotation of the cable or by longitudinal movement of the cable, relative to the cap.

Those of skill in the art will recognize that there are numerous equivalent structures to those mentioned above that may be used without changing the invention. As an example, the wall 121 that is part of junction box 116 is an example only of a barrier across which a plenum seal is to be formed. The barrier could be defined by many other structures, such as a different wall of a junction box, a plate, a wall or ceiling, or a plate that has a decorative appearance that is attached to a wall or ceiling or the like. For example, with reference to FIG. 9 and the junction box 80 illustrated in that figure, the wall of the junction box 80 that rests against the surface 82 of ceiling tile 74 could define the barrier across which the plenum seal is established with plenum seal apparatus 100.

Similarly, the threaded attachment between the plenum cap 120 and the junction box adapter 150 may be replaced with other suitable attachment structures for joining the two, such as a bayonet type of fitting or other mechanical attachment or even magnetic attachment. As another example of a structure described herein that may be readily modified, the size of the hollow interior 122 of plenum cap 120 may be modified according to the type and size of connector that will be housed in the interior.

Figure 16:
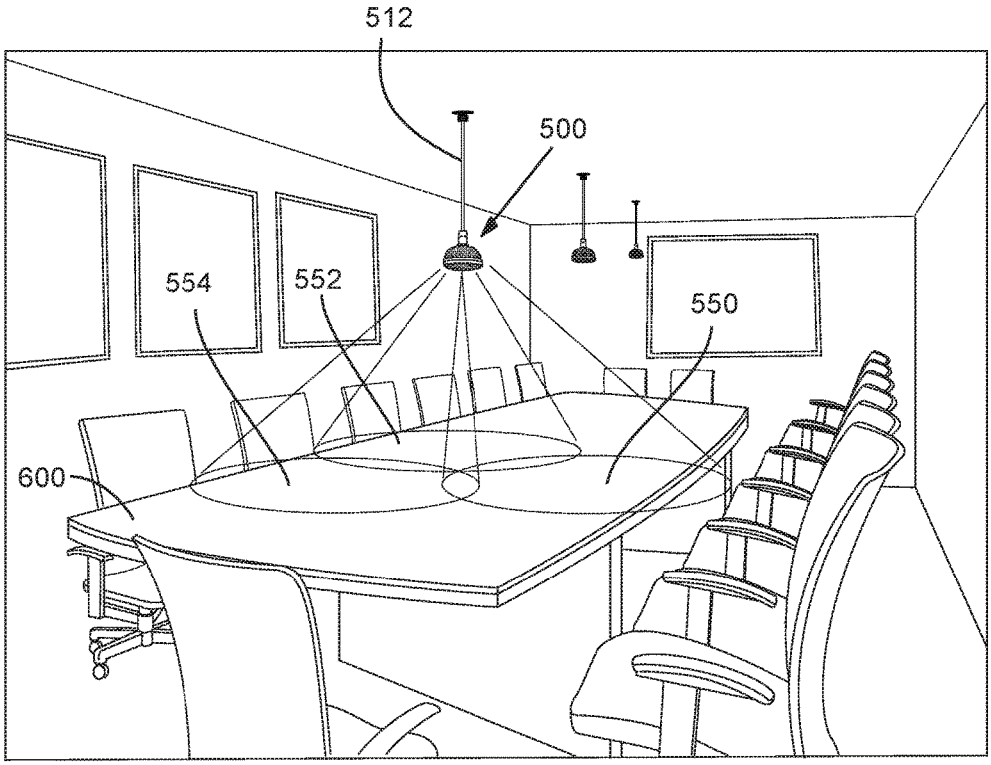
FIG. 16 is a schematic illustration of a conference room in which a multi-element mic according to the present invention has been suspended below the ceiling and over a table in the conference room.
Figure 18:
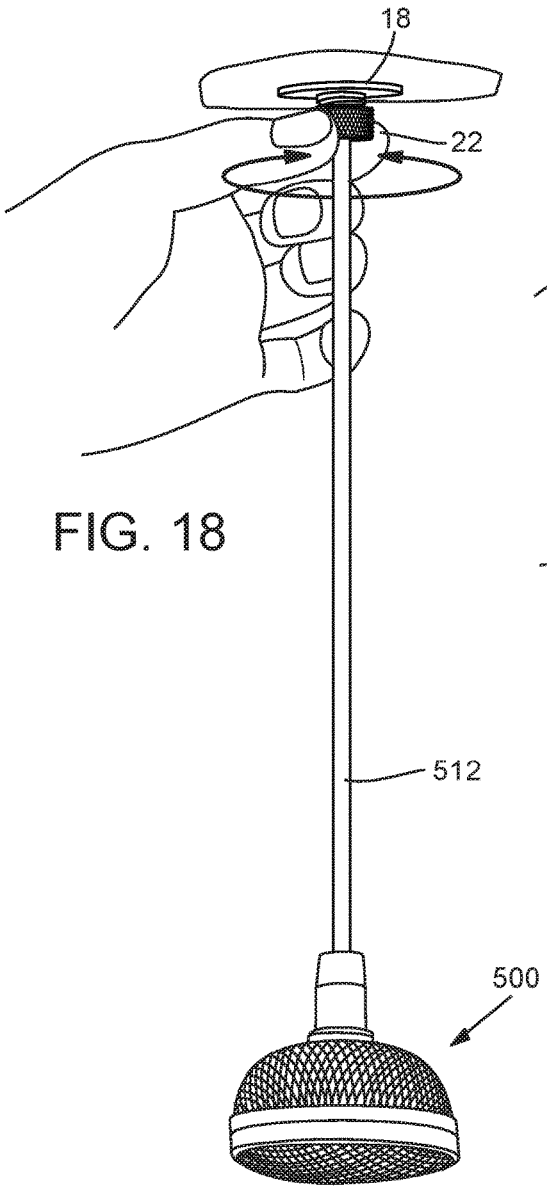
FIG. 18 is a side elevation view of a multi-element mic according to the present invention suspended from a ceiling and illustrating adjustment of the mic position.
Figure 19:
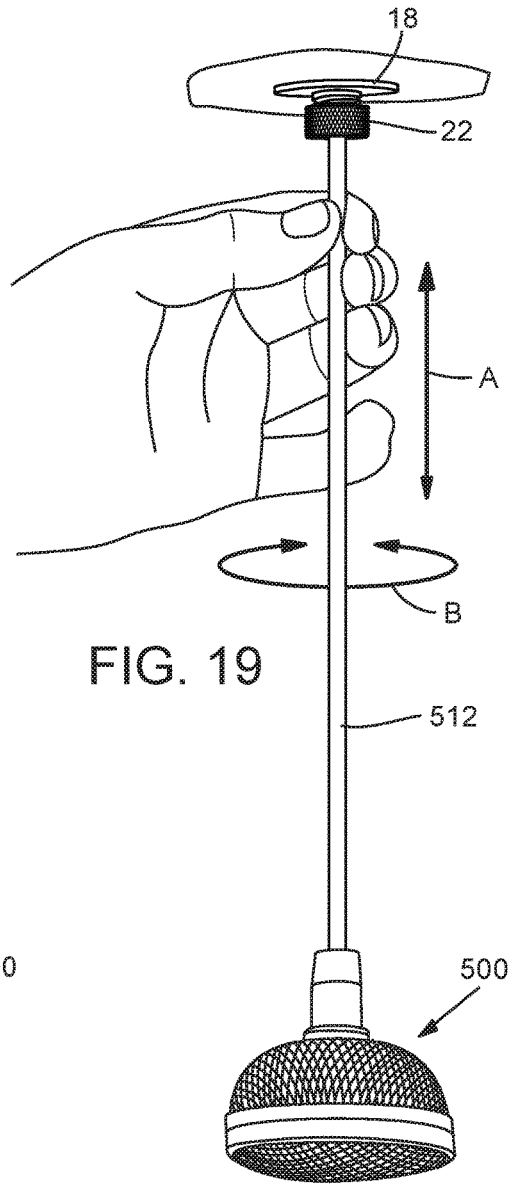
FIG. 19 is a side elevation view similar to the view of FIG. 18, also showing adjustment of the mic position.

With returning reference to the microphone assembly 500 illustrated in FIGS. 1A, 1B, 1C and 1D and then again in FIGS. 16, 18 and 19, the method of adjusting the position of the mics will now be described. It will be understood that as described above the mic assembly 500 is used in combination with an adaptor 10 such as that shown in Figs. Through 8 as described above. In other words, with reference to Figs. B and D, the microphone suspension cable 512 of Figs. B and D is identical to the microphone cable 38 shown in FIG. 6, with cable 512 extending through the adaptor 10. Adaptor 10 extends through bore in the ceiling tile and an aligned bore 88 in the above-ceiling junction box 542, and as described above of the type of embodiment shown in FIG. 5, with a relatively larger and longer second threaded end 16.

It will be appreciated that the adaptor extends through ceiling tile 74 as shown and described elsewhere.

As detailed above a significant length of cable 512 may be coiled in junction box 542. If a user wants to increase the length of the cable below the ceiling tile, for example, to reposition the microphone assembly 500 that is attached to the distal—that is, lower end of the suspension cable 512, the cap 22 on the adjustment, below-ceiling side of the adaptor 10—which is the side of the installation shown in FIGS. 7 and 8 and which extends through the ceiling tile, is loosened. This allows the cable to be pulled downwardly—the excess cable coiled in the junction box allows the length of the cable below the tile to be increased. Specifically, when cap 22 is loosened the O-ring 40 in adaptor 10 is decompressed from around suspension cable 512. This allows the suspension cable 512 to be slid through the adaptor so that the microphone assembly 500 may be pulled downwardly, that is, toward a table (e.g., FIGS. 18 and 19), or pushed upwardly away from the table as shown with arrow A in FIG. 19.

In addition, with the cap 22 of adaptor 10 loosened so that the O-ring is not compressed against the cable 512, the suspension cable 512 and the microphone assembly 50 may be axially rotated to allow the individual microphones 502, 504 and 506 to be "pointed" in the desired direction relative to the table. This is illustrated schematically with arrow B in FIG. 19. The cap 22 is then tightened, causing compression of the O-ring 40 against the suspension cable 512 and thereby fixing the direction at which the mics are pointed. With returning reference to FIG. 16, the positions of the cones identified with reference numbers 550, 552, 554 that symbolically represent the area of coverage of each of the three mics 502, 504 and 506, respectively, may be changed relative to the table 600 in the conference room by axially rotating the suspension cable 512 as described above, and fixed in the desired position by securing the adaptor 10. This allows the audio coverage of the mics to be optimized for any given situation.

The adaptor 10 in combination with the mic assembly 500 thus defines a locking or securing mechanism that, when in a first unlocked position, allows the mic assembly to be moved in two different respects or axes of movement: namely, longitudinally in respect of the axis of the suspension cable to vary the height of the mic assembly, and axially to vary and adjust the rotational position of the individual microphones so that the mics are in a desired position. When the adaptor 10 is tightened the adaptor is thus in the second, locked position that fixes both the vertical height of the mic assembly 500 and the rotational pointing position of the mics in the mic assembly, and in which a plenum seal through adaptor 10 is established. In the second or locked position, the suspension cable is relatively immovable relative to the adaptor as a result of the compression of the O-ring around the cable, as described previously. And it will be noted that while the second position is referred to a "locked" position, the cable is relatively immovable, meaning that movement is restrained under normal conditions but not under all conditions, for example, if excessive tension is applied to the cable.

The length of the cable 512 below the ceiling tile may also be shortened by reversing the sequence described above and pushing the cable back up through the adaptor, where it bunches up in the junction box 80.

When cap 22 is tightened to fix the suspension cable 512 relative to the main body 12 of adaptor 10, there is no air-passageway through the main body because the O-ring 40 is compressed around the cable 512 as detailed above and thereby defines an air tight seal of the bore 20. There is, therefore, a plenum seal maintained between the space under the ceiling tile and the air space above the tile insofar as the adaptor 10. Accordingly, the adaptor 10 of the present invention is usable in situations where the cable is routed through the ceiling (or wall) where a plenum seal rating is desired.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. Apparatus for suspending a microphone from a ceiling, comprising:

a multi-element microphone assembly including plural microphones, the assembly attached to a suspension cable;

an adaptor extending through a bore in the ceiling, the adaptor comprising a main body having a first end, a second end, and a bore extending through the main body through which the suspension cable extends, wherein an opening to the bore at the first end defines a surface that is inwardly sloped toward the bore;

a cap on the first end and an opening in the cap aligned with the bore;

an O-ring between an interior surface of the cap and the main body such that the O-ring is compressed into the sloped surface as the cap is moved toward the main body; and wherein, the adaptor may be selectively adjusted between a first position in which the O-ring is compressed around the suspension cable to thereby render the suspension cable immovable relative to the adaptor, and a second position in which the O-ring is decompressed from the suspension cable to thereby render the suspension cable movable relative to the adaptor.

2. The apparatus according to claim 1 wherein when the adaptor is in the first position a plenum seal is established through the bore.

3. The apparatus according to claim 1 in which the suspension cable may be moved relative to the adaptor in two axes of movement when the adaptor is in the second position.

4. The apparatus according to claim 3 in which the suspension cable defines a longitudinal axis and the two axes are defined by longitudinal movement of the suspension cable and axial movement of the suspension cable.

5. The apparatus according to claim 1 wherein the first end of the main body comprises a first threaded end and the cap is threaded onto the first threaded end.

6. The adaptor of claim 5 wherein the second end of the main body comprises a second threaded end and including a nut threaded onto the second end, wherein the nut defines a threaded opening through which the suspension cable extends.

7. The adaptor according to claim 1 in which the multi-element microphone assembly comprises three microphones and the suspension cable defines a longitudinal axis, each of the three microphones directed away from the axis and wherein when the adaptor is in the first position the three microphones may be pointed in a desired radial direction relative to the axis.

8. The adaptor according to claim 7 in which the desired radial direction is fixed when the adaptor is in the second position.

9. Apparatus for suspending a microphone from a ceiling, comprising:

a microphone attached to a suspension cable;

a lock member extending through a bore in the ceiling, the lock member defined by a main body having a first end that defines an compression element seat, a second end, and a bore through which the suspension cable extends, a cap on the first end through which the suspension cable extends, and a compression element in the compression element seat through which the suspension cable extends;

wherein the lock member is selectively movable between a first position in which the suspension cable is immovable relative to the lock member, and a second position in which the suspension cable is movable relative to the lock member; and wherein rotation of the cap in one direction compresses the compression element on the suspension cable to move the lock member to the first position to form an air tight seal in the bore and rotation of the cap in an opposite direction decompresses the compression element from the suspension cable.

10. The apparatus according to claim 9 in which the suspension cable defines an axis and when the lock member is in the second position the microphone may be moved parallel to the axis and rotationally around the axis.

11. The apparatus according to claim 10 in which a rotational position of the microphone relative to the axis is fixed when the lock member is in the first position.

12. Apparatus for suspending a microphone from a ceiling, comprising:

a microphone connected to a suspension cable below the ceiling;

an adaptor extending through a bore in the ceiling, the adaptor having an elongate main body with a bore extending through the main body and through which the suspension cable extends;

a compression member in the adaptor through which the suspension cable extends, the compression member selectively movable between a first position in which the bore is fluidly sealed, and a second position in which the bore is not sealed.

13. The apparatus according to claim 12 wherein adaptor has a first end and a second end and the bore at the first end defines a surface that is inwardly sloped toward the bore, and further including a cap on the first end with an opening in the cap aligned with the bore.

14. The apparatus according to claim 13 in which the compression member is defined by an O-ring.

15. The apparatus according to claim 14 in which the O-ring is received in the sloped surface in the first end of the bore.

16. The apparatus according to claim 15 including a cap that bears against the O-ring, the cap movable in a first direction to thereby compress the O-ring against the suspension cable in the first position, and in a second direction to thereby decompress the O-ring from the suspension cable in the second position.

* * * * *